US009456279B1

(12) United States Patent
Murdoch

(10) Patent No.: US 9,456,279 B1
(45) Date of Patent: Sep. 27, 2016

(54) AUTOMATIC CONTROL AND GROUPING OF MEDIA PLAYBACK DEVICES BASED ON USER DETECTION

(71) Applicant: Google Inc., Mountain View, CA (US)

(72) Inventor: Benjamin Hal Murdoch, London (GB)

(73) Assignee: GOOGLE INC., Mountain View, CA (US)

( * ) Notice: Subject to any disclaimer, the term of this patent is extended or adjusted under 35 U.S.C. 154(b) by 364 days.

(21) Appl. No.: 13/893,428

(22) Filed: May 14, 2013

(51) Int. Cl.
*H04R 27/00* (2006.01)
*H04R 3/12* (2006.01)

(52) U.S. Cl.
CPC ..... *H04R 3/12* (2013.01)

(58) Field of Classification Search
CPC ..... H04R 3/12; H04R 1/403; H04R 5/04; H04R 2499/13; H04R 27/00; H04R 2205/024; H04R 2217/03; H04R 2227/005; H04R 2420/03; H04R 19/02; H04R 5/00; H04R 3/00; H04R 7/00; H04S 2420/01; H04S 7/302; H04S 7/303; H04S 2400/01; H04S 2400/11; H04S 3/00; H04S 3/008; H04S 7/30; H04S 7/00; H04B 3/54; H04B 27/00; H04L 12/1895
USPC ..... 381/1, 17, 18, 300, 301, 302, 303, 305, 381/307, 310, 311, 61, 77, 80, 81, 82, 85, 381/86, 332, 334, 104, 107, 110, 119, 123; 700/94
See application file for complete search history.

(56) References Cited

U.S. PATENT DOCUMENTS

| | | | | |
|---|---|---|---|---|
| 8,239,559 | B2 | 8/2012 | Rajapakse | |
| 2011/0116640 | A1* | 5/2011 | Matsumaru | H04S 7/303 381/17 |
| 2011/0291832 | A1 | 12/2011 | Al-Kadi et al. | |
| 2012/0271970 | A1 | 10/2012 | Mason | |
| 2013/0343566 | A1* | 12/2013 | Triplett et al. | 381/77 |

FOREIGN PATENT DOCUMENTS

JP 2007074710 A * 3/2007

OTHER PUBLICATIONS

Thomassen et al.,"Follow Me Music", Available at: https://blog.itu.dk/SPVC-E2010/files/2011/08/5followmemusic.pdf. Published: 2010, Visited on: Dec. 19, 2012.

* cited by examiner

*Primary Examiner* — Leshui Zhang
(74) *Attorney, Agent, or Firm* — Morris & Kamlay LLP

(57) ABSTRACT

Systems and techniques are provided for detecting the location of a user, stopping media output from a first media output device, and selecting a second media output device for output of media, based on the detection. Media output from a first media output device may be stopped based on the detection or based on media output from the second media output device. A media control device used to select or control the media output may remain proximate to the first media output device as the second media output device is selected. For example, a first output device may output a media component selected by a user located proximate to the first output device. The user may exit the location and enter a second location proximate to a second output device. The media component may be output from the second output device based on detecting the user at the second location.

27 Claims, 6 Drawing Sheets

AUTOMATIC CONTROL AND GROUPING OF MEDIA PLAYBACK DEVICES BASED ON USER DETECTION

BACKGROUND

Traditional media output devices, such as speakers or televisions, are generally configured to output media when a user requests media output and continue to output the media until the user requests to stop the output or if a condition, such as a timer expiring, is met. A user that changes locations from a first area to a second area generally has to send a second request to a second media output device located in the second location to receive media output at that location. Alternatively or in addition, a user may carry a portable device, such as a mobile phone, with her from the first location to the second location to enable playback at the second location. The portable device may be detected at the second location and, accordingly, media may be output at the second location based on the detection of the portable device in the second location.

BRIEF SUMMARY

According to implementations of the disclosed subject matter, a song selection may be received from a mobile phone located in a first room of a building and the song may be output from speakers located in the first room. A user may be sensed to be located in a second, separate and distinct, room of the building while the mobile phone is located in the first room. Playback of the song may be stopped in the first room and be initialized through speakers located in the second room based on sensing the user in the second room.

According to implementations of the disclosed subject matter, a media output request may be received from a first device located at a first location. Media content may be provided for output at the first location. A user may be detected in a second location physically remote from the first location and the media content may be provided for output at the second location based on detecting the user.

According to implementations of the disclosed subject matter, Media content may be provided for output at a first location. A user may be detected in a second location and the media content playback may be stopped at the first location based on detecting the user in the second location.

Systems and techniques according to the present disclosure may allow for providing media content at locations where a user is detected. The detection may be made by sensing the presence of the user, without requiring detection of an electronic device used to control media content playback. Such an implementation may allow a user to be exposed to media content when the user moves from one area to another, without having to carry a media controlling device. Additional features, advantages, and implementations of the disclosed subject matter may be set forth or apparent from consideration of the following detailed description, drawings, and claims. Moreover, it is to be understood that both the foregoing summary and the following detailed description include examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification.

The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Modifying the output of media content based on user location may allow the user to be exposed to media content in multiple locations without having to reconfigure separate media output devices when the user changes locations. For example, a user listening to music in the master bedroom of the user's home may move to the kitchen, also located in the user's home. The user's presence in the kitchen may be detected and, based on the detection, the music may be output from speakers in the kitchen. Additionally, a user may not be required to carry a music control device while moving from a first location to a second location in order for the media content to output in the second location. For example, a user located in a master bedroom may use a mobile phone to select a song to be output from speakers located in the master bedroom. The user may leave the master bedroom and move to the kitchen, while the mobile phone remains in the master bedroom. The user's presence in the kitchen may be detected and, based on the detection, the music may be output from speakers located in the kitchen. Notably, a media control device, such as the mobile phone in the example, may not be required for detecting a user's presence and, accordingly, for outputting media from a media output device located at or near a user's location.

Figure 3:
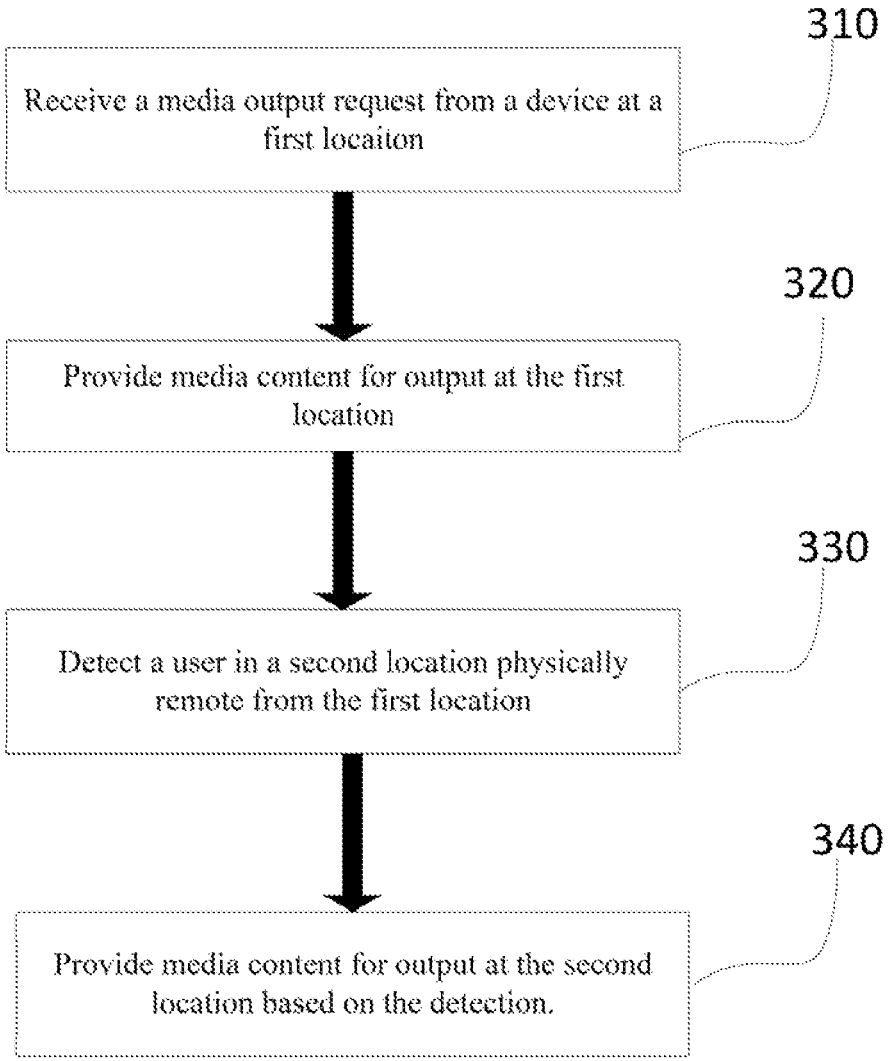
FIG. 3 shows an example process for providing media content, according to an implementation of the disclosed subject matter.

According to an implementation of the disclosed subject matter, as shown in FIG. 3 at step 310, a media output request may be received at a media output device from a media control device located at a first location. Media may be any applicable item such as, but not limited to, audio content, video content, or sensory content and may include songs, audio books, audio magazine, music video, television content, movies, documentaries, video clips, speeches, radio content, monitoring content (e.g., from a baby monitoring device output), or the like. A media output device may be any applicable output device such as, but not limited to, an audio output device, a video output device, or a content output device and may include a speaker, a receiver, a television, a projection device, a screen, or the like. The media output request may be initiated by directly accessing a media output device configured to accept media output requests. Directly accessing a media output device may include accessing a media output device storage that contains the media content, activating a peripheral component attached to the media output device (e.g., a CD player, a DVD player, a Blu-ray player, a computer based device attached to the media output device, an external storage device connected to the media output device, etc.), accessing a remote server from the media output device, or the like. For example, a user may select a song from a control panel on a receiver connected to audio speakers. The song may be stored on a CD inside a CD drive connected to the receiver and may be played through the audio speakers when a selection is made by the user. Alternatively, the media output request may be initiated by media control device that is not connected to a media output device. The media control device may be any applicable media player such as, but not limited to, a mobile phone, a tablet, a laptop computer, a desktop computer, a gaming console, a media player, a wearable media controller, or the like. For example, a mobile phone may store songs on a mobile phone hard drive, other integrated storage, or a removable storage. A user may select a song or a playlist containing multiple songs by accessing a user interface on the mobile phone. The mobile phone may communicate with a speaker system which outputs the song or playlist selected by the user. According to an implementation, the media control device may communicate with a remote server when requesting media output from a media output device. The remote server may provide the media output device with the requested media for output or, alternatively, the remote server may instruct the media output device to output media stored either on the media output device, the control device, or a remote device. For example, a user located in a master bedroom of a house may use a tablet to access a website containing streamable videos. The user may select a music video from the website for streaming on a television also located in the master bedroom. The tablet may communicate with the remote server storing the music video and instruct the server to stream the music video on the television located in the master bedroom.

At step 320, media content may be output at a first location. The first location may be the location from which a user initiates output of media content. For example, the first location can be a user's bedroom such that the user may select a song on her mobile phone to be output on speakers located within the bedroom. Alternatively, the first location may be a location where media content is output based on a user being present at the location. As an example, a user, while located in the bedroom, may select a song on her mobile phone without specifying an output media device or location. The location of the user or the user's mobile phone's may be detected, and speakers located within the bedroom may output the song based on the user or the user's phone being located in the bedroom.

Figure 5:
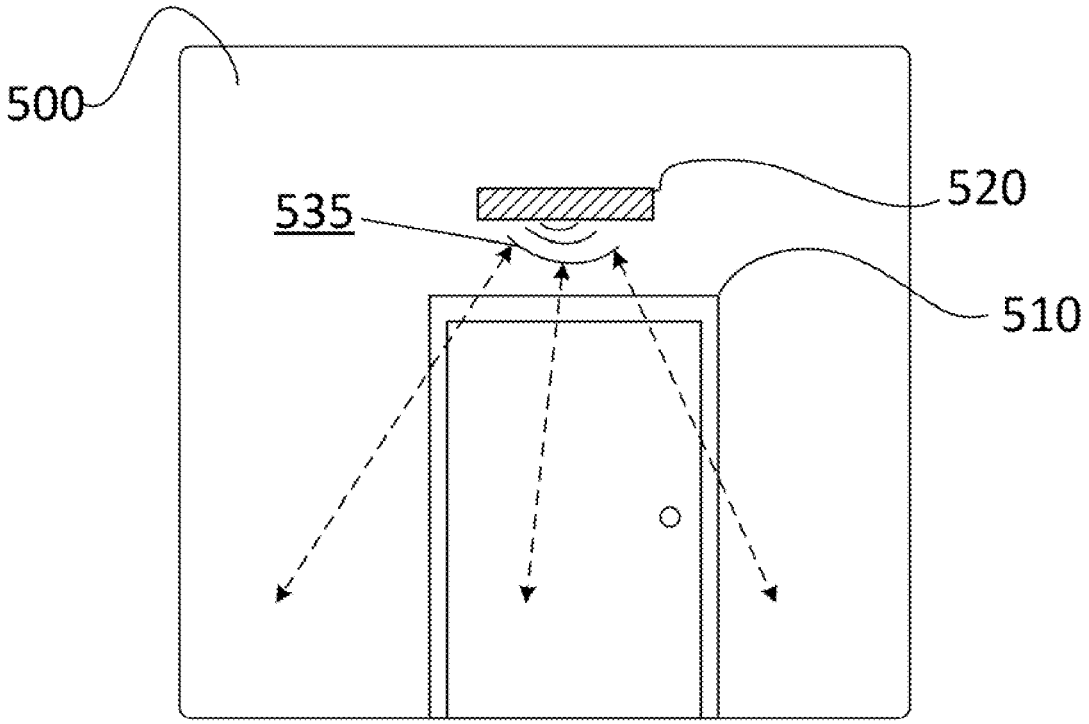
FIG. 5 shows an example illustration of user detection according to an implementation of the disclosed subject matter.

A user may move from a first location to a second location and, at step 330, the user's presence at the second location may be detected. The user may be detected using any applicable detection sensor such as a motion sensor, a biometric sensor, a sound sensor, a heat sensor, a position sensor, a sonar sensor, an infra-red sensor, proximity sensor, or the like or a combination thereof. As an example, as shown in FIG. 5, a motion sensor 520 may be placed above an entrance 510 to a room 500. The entrance may be a door or other opening that a user may traverse, such as an entryway, threshold, or the like. The motion sensor 520 may be positioned such that it can send and/or receive signals 535 that detect a user's motion when the user enters the room 500, when the user remains in the room 500, when the user leaves the room 500, or a combination of thereof. The motion sensor may be configured to activate or deactivate based on one or more predetermined threshold based rules such as, but not limited to, time of day, a pre-set time, a pre-set date, a lighting based condition, a type of media playback condition (e.g., what type of media content is being played by a user), or the like. As an example, a user may preset a sensor to turn off during the hours of 10:00 pm and 6:00 am. Accordingly, the sensor may deactivate during 10:00 pm and 6:00 am for as long as the user does not modify the condition. Namely, deactivating a sensor may prevent media output in or near the location where the sensor is placed and the media output location may not change from a first location to the sensor's location, as disclosed herein. Deactivating a sensor based on a condition may be beneficial as deactivating the sensor may prevent the output of a media component at an undesired time or it may prevent the output of a media component type.

Media content may be provided for output at the second location based on the detection of a user at the second location, as shown in step 340. As disclosed herein, media content may be output at a first location, and the first location may be based on a user presence. Subsequently, the user may move to a second location and the user's presence in the second location may be detected. Based on the detection, media content that was originally output at the first location may be provided to an output device located in or near the second location and the media output at the first location may be stopped based on either the output of the media content at the second location or the detection of the user at the second location. Media content may be output at the second location if a predetermined condition is met. The predetermined condition may be any applicable threshold condition such as, but not limited to, time of day, a pre-set time, a pre-set date, a lighting based condition, a type of media playback condition (e.g., what type of media content is being played by a user), or the like. As an example, an arrangement of output devices may be configured to transfer media content based a user's location between 8:00 am and 10:00 pm. A movie may be output by a television in a user's bedroom at 7:00 pm, while the user is in the bedroom. The user may move to a living room, and a motion sensor may detect the user in the living room. Accordingly, a television in the living room may initiate output of the movie and the television in the bedroom may suspend output of the movie as disclosed herein. Alternatively, the movie may be output by the television in the user's bedroom at 11:00 pm, while the user is in the bedroom. Subsequently, sensing the user in the living room may cause no change in output device because 11:00 pm is not within the set range of 8:00 am to 10:00 pm. In this example, the movie may continue to output from the television in the user's bedroom. As another example, the movie may be stopped or paused in the user's bedroom, and may be re-started if the user returns to the bedroom.

The media content may be output by the output device starting at a media point corresponding to a time when the user is detected at the second location. The media point may be a time that the media content progresses to without causing artificial shifting. As an example, a user, in her living room, may listen to a song output by speakers located in the living room. A motion sensor may detect that the user exits the living room at the song's media point of 2 minutes and 20 seconds such that 2 minutes and 20 seconds elapse in the song when the user exits the living room. The song may continue to play at the living room until the user is detected in a bedroom, at the song's media point of 2 minutes and 40 seconds. Accordingly, the song may be output from speakers located in the bedroom at the media point of 2 minutes and 40 seconds such that no artificial shift of the media point is caused, i.e., as if the song had continued to play as the user moved from the first location to the second. Alternatively, the media content may be output by the output device located at a second location starting at a shifted media point. The media point may be shifted based on a predetermined value or, the shift may be dynamically determined based on any applicable calculation such as, but not limited to, the amount of time the user spent traveling from the first location to the second location, a predetermined amount of time based on the first and second location, a time determined based on the type of media, a time based on a user, or the like. For example, a user, in her living room, may listen to a song output by speakers located in the living room. The user may exit the living room at the song's media point of 2 minutes and 20 seconds such that 2 minutes and 20 seconds elapse in the song when the user exits the living room. The user may take 25 seconds to reach her bedroom such that the song's media point when she enters the bedroom is at 2 minutes and 45 seconds. The user may be detected in the bedroom and the configuration may access a lookup table to determine that a {living room:bedroom} pair corresponds to a 20 second media point shift. Accordingly, the song may be output through speakers located in the bedroom starting at a media point of 2 minutes and 25 seconds (2 minutes 45 seconds less 20 seconds based on the shift). Notably, a shift may be added to allow a user to be exposed to at least a majority of media content without losing exposure during travel from one location to another. As another example, the media content may be output at the second location at the same point at which it was stopped at the first location. Continuing the example above, the song may resume playing in the bedroom at the 2 minute 20 second media point, i.e., the point at which the user left the living room.

According to an implementation of the disclosed subject matter, the first and second locations, as disclosed herein, may be within a predetermined region. The predetermined region may by any applicable identifiable region such as, but not limited to, a home, an office, a building, a structure, an area controlled by a local media server, or the like. An area controlled by a local media server may be an arrangement such that multiple media output devices are connected to a central media server located locally to the media output devices. The local media server may store media content and may provide media content to one or more of the media output devices. Alternatively or in addition, the media content may control the media output devices by providing any applicable instruction to the media output device such as, but not limited to, media content to output, activation instructions, deactivation instructions, media point shift instructions, sensor results, or the like. One or more media output devices and the local media server may be part of a network and may connect via any applicable communication protocol such as Wi-Fi, Bluetooth, Ethernet, a proprietary protocol, or the like. Namely, the media output devices within a predetermined region may communicate with each other or with a central control device to allow media content to be output at locations where a user may be exposed to the content.

Figure 4A:
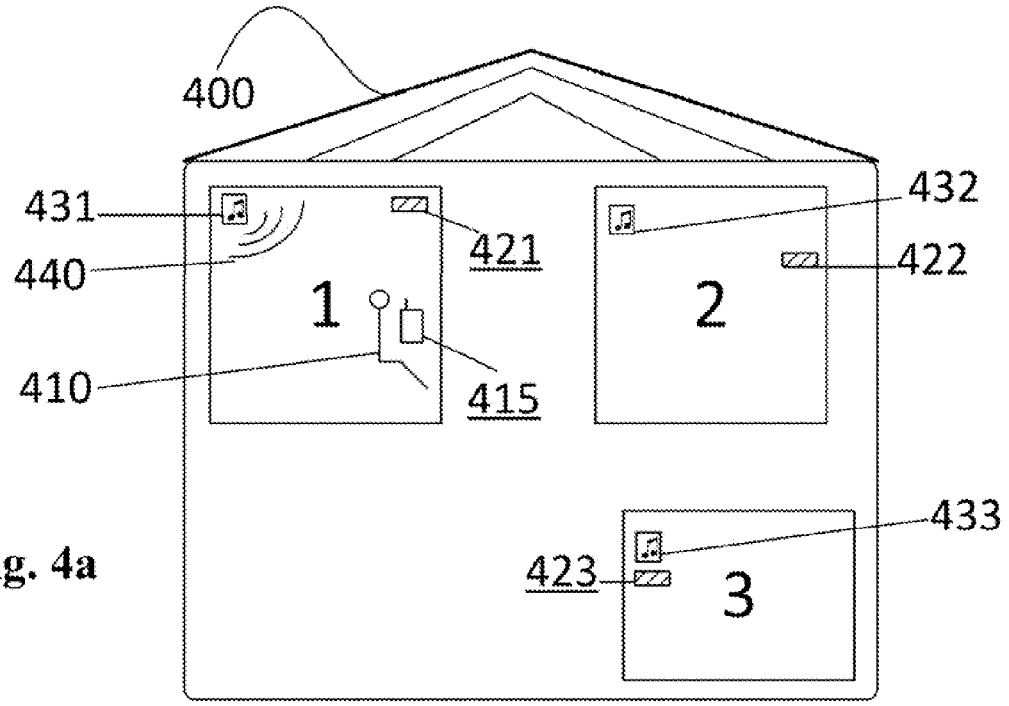
FIG. 4*a* shows an example illustration of media output as a user is in a first location according to an implementation of the disclosed subject matter.
Figure 4B:
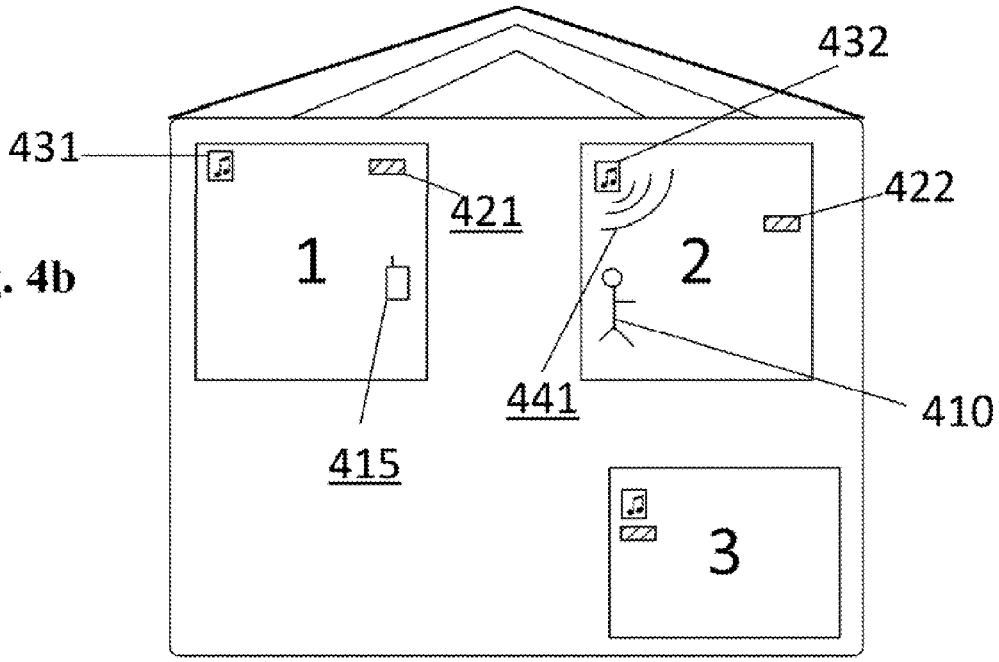
FIG. 4*b* shows an example illustration of media output as a user is in a second location according to an implementation of the disclosed subject matter.

According to an illustrative example of the disclosed subject matter, as shown in FIG. 4*a*, a house 400 may contain three locations; 1, 2, and 3. Location 1 may contain a speaker 431 and motion sensor 421. Similarly, location 2 may contain a speaker 432 and motion sensor 422 and location 3 may contain a speaker 433 and motion sensor 433. A user 410 located at location 1 may select a song on a mobile device 415 and the song may be output 440 through the speaker 431 located at location 1. The song may be stored on mobile device 415 and may be streamed on speaker 431 via a wireless connection between the mobile device 415 and speaker 431. Alternatively, the song may be stored on a remote server (not shown) and may be transmitted to the speaker 431 based on an instruction sent to the remote server from the mobile device 415. As shown in FIG. 4*b*, the user 410 may enter location 2 within the house 400 prior to the song being complete and motion sensor 422 may detect the user at location 2. Accordingly, speaker 432 located at location 2 may output 441 the song at an unshifted media point, as disclosed herein. The speaker 431 at location 1 may stop output of the song when motion sensor 421 at location 1 detects that user is no longer at location 1. Alternatively, the speaker 431 at location 1 may stop output of the song when motion sensor 422 at location 2 detects that the user is at location 2. Alternatively, the speaker 431 at location 1 may stop output of the song when speaker 432 initiates output of the song. Notably, as shown in FIG. 4*b*, the mobile device 415 used to select the song may remain at location 1 while the user moves to location 2 and the song is output by the speakers located at location 2.

Figure 4C:
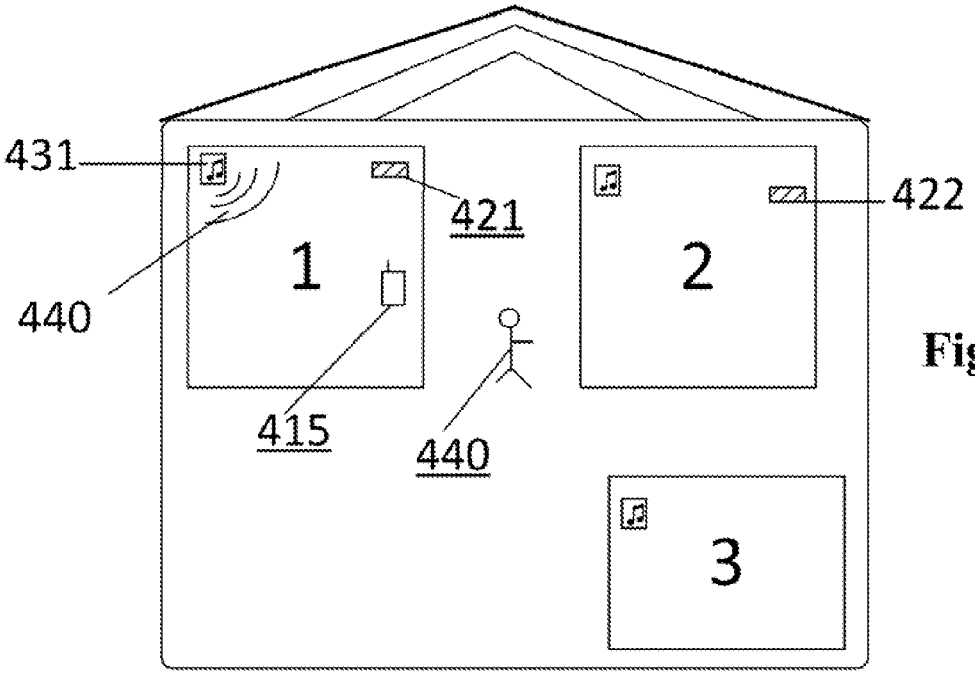
FIG. 4*c* shows an example illustration of media output as a user is between a first location and a second location according to an implementation of the disclosed subject matter.
Figure 4D:
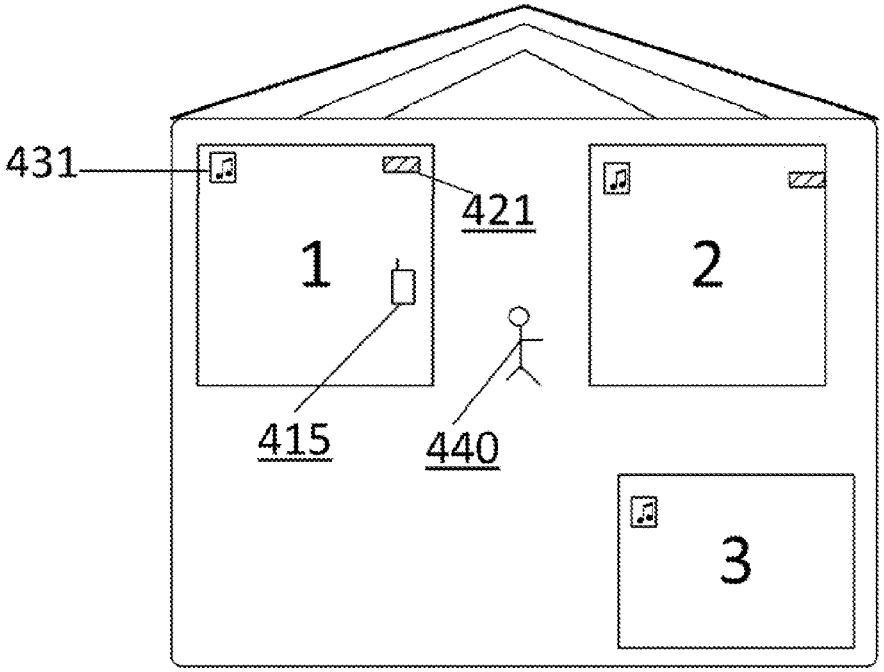
FIG. 4*d* shows an example illustration of media output as a user is between a first location and a second location according to an implementation of the disclosed subject matter.

According to an illustrative example of the disclosed subject matter, as shown in FIG. 4*c*, a user 440 may use the mobile device 415 to select a song, and the song may be output 440 at location 1 by speaker 431. The user 440 may exit location 1 and the sensor 421 may detect that the user is no longer at location 1. The speaker 431 located at location 1 may continue to output the song when the user exits location 1. The speaker 431 may continue to output the song until the user enters another location, such as location 2, until the user inputs an instruction to stop output of the song, or until the song ends. Alternatively, a user 440 may use the mobile device 415 to select a song, and the song may be output at location 1 by speaker 431. As shown in FIG. 4*d*, the user 440 may exit location 1 and the sensor 421 may detect that the user is no longer at location 1. Based on the detection, speaker 431 may stop the output of the song and may not resume output of the song until the user 440 is detected in location 1.

Figure 6A:
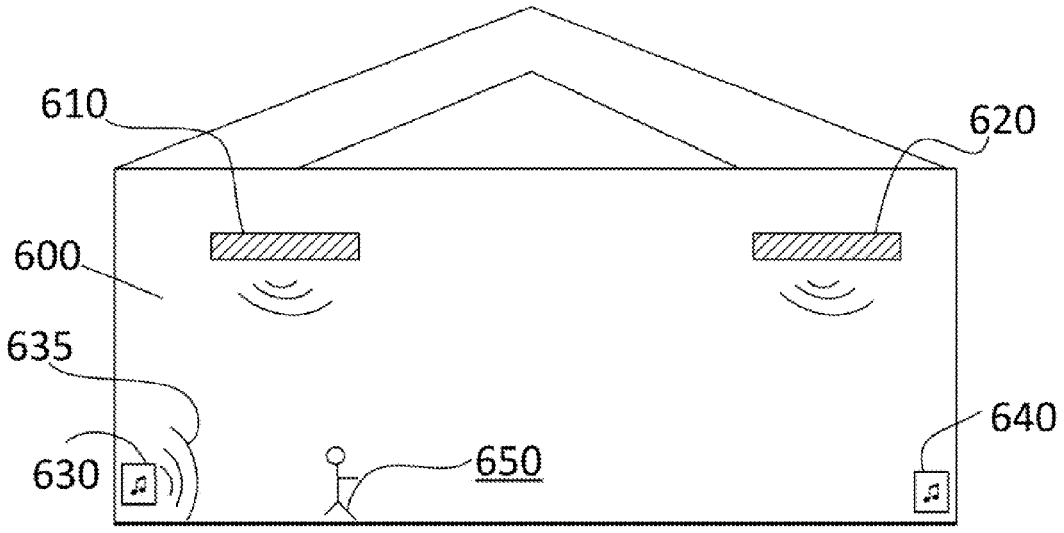
FIG. 6*a* shows an example illustration of media output as a user is in a first area according to an implementation of the disclosed subject matter.
Figure 6B:
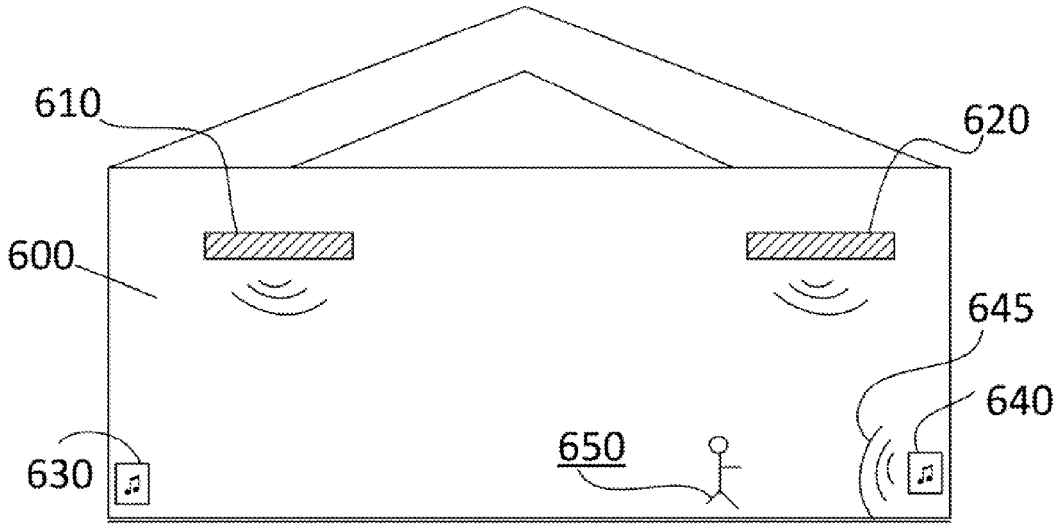
FIG. 6*b* shows an example illustration of media output as a user is in a second area according to an implementation of the disclosed subject matter.

According to an implementation of the disclosed subject matter, a first location may be a distance from a point and may not be physically separated from another location by components such as walls, doors, barriers, levels, or the like. The physical distance from a point may be any applicable separation distance determined based on, but not limited to, a second location, an audio quality loss point such that the quality of output from an output device at a first location falls below a certain threshold quality, a second output device, or the like. As an illustrative example, as shown in FIG. 6*a*, a speaker 630 within a studio apartment 600 may output media content based on the detection of a user 650 by a motion sensor 610 located proximally close to the speaker 630. As shown in FIG. 6*b*, the user 650 may move to a second part of studio apartment 600. According to this example, the different part of the studio apartment 600 may be far enough from speaker 630 such that the quality of the sound originally output by speaker 630, at the second part of the studio apartment 600, may fall below an acceptable quality threshold. However, sound output 645 from a speaker 640 located near the second part of the studio apartment 600 may be above an acceptable quality threshold. Accordingly, based on detection of the user 650 by motion sensor 620, output from speaker 630 may be stopped and speaker 640 may output the media content. According to an embodiment of the disclosed subject matter, multiple users may be detected at two or more locations and media content may be output out of two or more output devices based on the selection. Continuing the previous example, in FIG. 6*b*, a second user (not shown) may be detected by motion sensor 610 and media content may be output from both speakers 630 and 640 based on the detection of the second user (not shown) by motion sensor 610 and the original user 650 by motion sensor 620. Different regions within a region containing multiple locations as disclosed herein also may be defined by a user and/or by the placement of sensors to separate one location from another. For example, within a relatively large region such as a hall, warehouse, auditorium, outdoor space, or the like, sensors as disclosed herein may be placed so as to define multiple locations within the area. A sensor that detects a user may then operate as disclosed herein for sensors in separate rooms, although otherwise the separate locations would be considered a single region. Thus, two locations may not be physically divided by an intervening wall or similar physical obstruction, while still being considered separate locations as disclosed herein.

Figure 1:
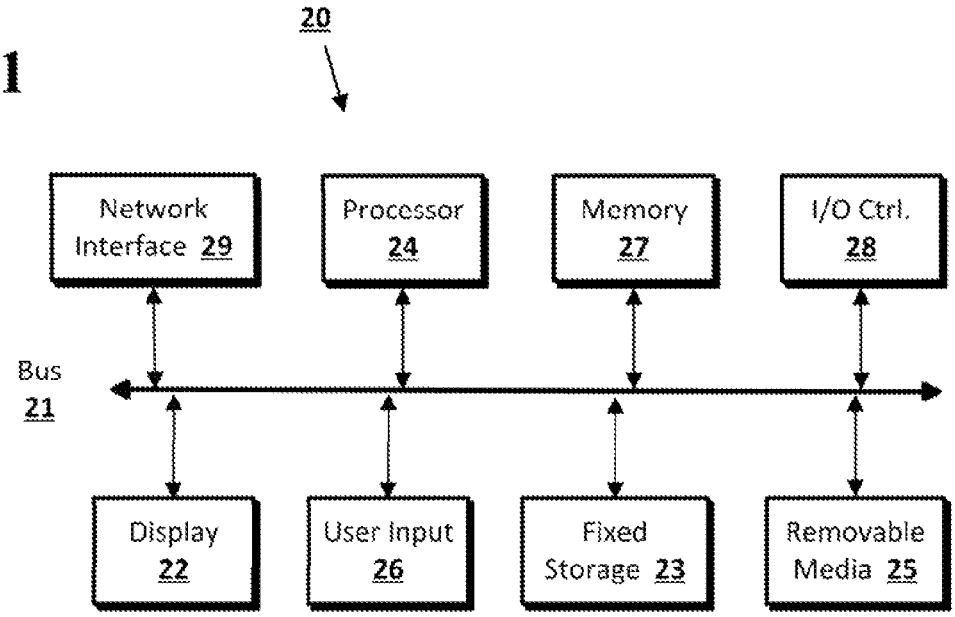
FIG. 1 shows a computer according to an implementation of the disclosed subject matter.

Implementations of the presently disclosed subject matter may be implemented in and used with a variety of component and network architectures. FIG. 1 is an example computer 20 suitable for implementing implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display or touch screen via a display adapter, a user input interface 26, which may include one or more controllers and associated user input or devices such as a keyboard, mouse, WiFi/cellular radios, touchscreen, microphone/speakers and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM can include the main memory into which the operating system and application programs are loaded. The ROM or flash memory can contain, among other code, the Basic Input-Output system (BIOS) which controls basic hardware operation such as the interaction with peripheral components. Applications resident with the computer 20 can be stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection or the like. For example, the network interface 29 may allow the computer to communicate with other computers via one or more local, wide-area, or other networks, as shown in FIG. 2.

Many other devices or components (not shown) may be connected in a similar manner (e.g., document scanners, digital cameras and so on). Conversely, all of the components shown in FIG. 1 need not be present to practice the present disclosure. The components can be interconnected in different ways from that shown. The operation of a computer such as that shown in FIG. 1 is readily known in the art and is not discussed in detail in this application. Code to implement the present disclosure can be stored in computer-readable storage media such as one or more of the memory 27, fixed storage 23, removable media 25, or on a remote storage location.

Figure 2:
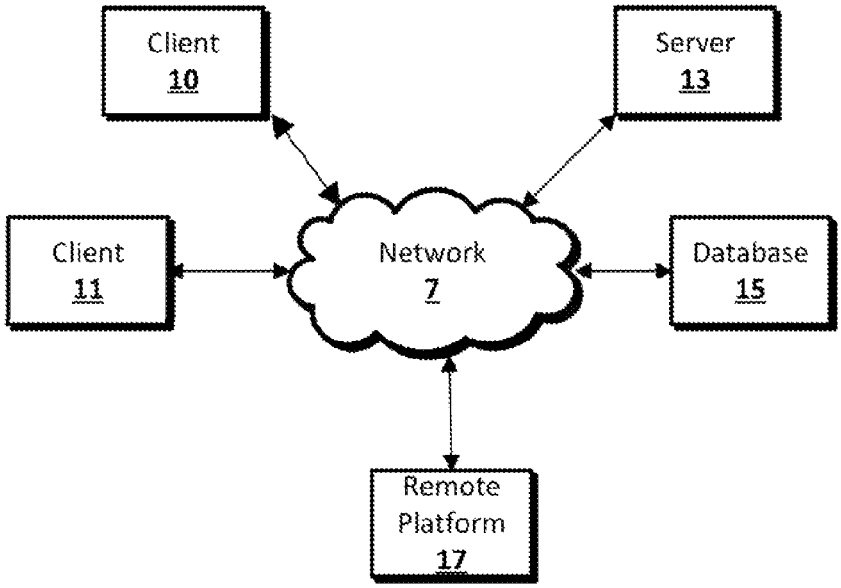
FIG. 2 shows a network configuration according to an implementation of the disclosed subject matter.

FIG. 2 shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. Implementations also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general purpose microprocessor and/or an Application Specific Integrated Circuit (ASIC) that implements all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A method comprising:

receiving a song selection from a mobile phone located in a first room of a building;

outputting the song from a first speaker located in the first room;

sensing a user in a second room of the building while the mobile phone is located in the first room, the second room being separate and distinct from the first room;

stopping playback of the song in the first room in response to the sensing of the user in the second room; and initializing playback of the song through a second speaker located in the second room at a shifted media point that is dynamically determined based on a difference between a time that the user is detected exiting the first room and a time that the user is detected at the second room wherein the shifted media point allows the user to be exposed to the media content without losing exposure during travel from the first location to the second location.

2. A method comprising:

providing media content for output at a first location in response to a detection of a user at the first location;

detecting the user in a second location physically remote from the first location; and providing the media content for output at the second location from a shifted media point that is dynamically determined based on a difference between a time that the user is detected exiting the first location and a time that the user is detected at the second location, wherein the shifted media point allows the user to be exposed to the media content without losing exposure during travel from the first location to the second location.

3. The method of claim 2, wherein the second location and the first location are within a predetermined region.

4. The method of claim 2, wherein the first location and the second location are not physically divided.

5. The method of claim 3, wherein the predetermined region is selected from a group consisting of a user's home, an office, and an area controlled by a local media server.

6. The method of claim 2, further comprising, prior to providing the media content for output at the first location, receiving a media output request from a first device located at the first location.

7. The method of claim 6, wherein the second location is determined while the first device is located within the first location.

8. The method of claim 2, wherein output of the media content is stopped at the first location when the media content is provided for output at the second location.

9. The method of claim 2, wherein output of the media content is stopped at the first location when the user is detected at the second location.

10. The method of claim 2, wherein the media content provided for output at the second location is activated at a media point corresponding to a time when the user is detected at the second location.

11. The method of claim 2, wherein the media content provided for output at the second location is activated starting from a media point corresponding to a time when the user vacates the first location.

12. The method of claim 2, wherein detecting the user in the second location further comprises sensing the user using a sensor selected from the group consisting of: a motion sensor, a position sensor, a biometric sensor, a sound sensor, a temperature sensor, an infra-red sensor, and a sonar sensor.

13. The method of claim 2, wherein providing the media content for output at the second location further comprises outputting the media content if a current time meets a predetermined time threshold.

14. A method comprising:

providing media content for output at a first location;

detecting a user at a second location;

stopping media content playback at the first location based on detecting the user in the second location; and providing media content for output at the second location at a shifted media point that is dynamically determined based on a difference between a time that the user is detected exiting the first location and a time that the user is detected at the second location, wherein the shifted media point allows the user to be exposed to the media content without losing exposure during travel from the first location to the second location.

15. The method of claim 14, wherein the second location and the first location are within a predetermined region.

16. The method of claim 15, wherein the predetermined region is selected from a group consisting of a user's home, an office, and an area controlled by a local media server.

17. The method of claim 14, further comprising, prior to providing the media content for output at the first location, receiving a media output request from a first device located at the first location.

18. The method of claim 17, wherein the user is detected at the second location while the first device is located within the first location.

19. The method of claim 14, wherein the media content provided for output at the second location is activated at a media point corresponding to a time when the user is detected at the second location.

20. The method of claim 14, wherein the media content provided for output at the second location is activated starting from a media point corresponding to a time when the user vacates the first location.

21. The method of claim 14, wherein detecting a user in the second location further comprises sensing the user using a sensor selected from the group consisting of a motion sensor, a sound sensor, a temperature sensor, an infra-red sensor, and a sonar sensor.

22. The method of claim 14, wherein providing media content for output at the second location further comprises outputting the media content if a current time meets a predetermined time threshold.

23. A system comprising:

a media server;

a processor in connection with said media server, the processor configured to:

provide media content for output at a first location;

receive a signal corresponding to detecting a user in a second location physically remote from the first location; and provide media content for output at the second location at a shifted media point that is dynamically determined based on a difference between a time that the user is detected exiting the first location and a time that the user is detected at second location, wherein the shifted media point allows the user to be exposed to the media content without losing exposure during travel from the first location to the second location.

24. The system of claim 23 further configured to, prior to providing the media content for output at the first location, receiving a media output request from a first device located at the first location.

25. The system of claim 24, wherein the user is detected at the second location while the first device is located within the first location.

26. A non-transitory computer readable storage medium storing program instructions, which when executed by a processor, cause the processor to:

provide media content for output at a first location;

detect a user in a second location physically remote from the first location; and provide media content for output at the second location at a shifted media point that is dynamically determined based on a difference between a time that the user is detected exiting the first location and a time that the user is detected at the second location, wherein the shifted media point allows the user to be exposed to the media content without losing exposure during travel from the first location to the second location.

27. A non-transitory computer readable storage medium storing program instructions, which when executed by a processor, cause the processor to:

providing media content for output at a first location;

detecting a user at a second location;

stopping media content playback at the first location based on detecting the user in the second location; and providing media content for output at the second location at a shifted media point that is dynamically determined based on a difference between a time that the user is detected exiting the first location and a time that the user is detected at the second location, wherein the shifted media point allows the user to be exposed to the media content without losing exposure during travel from the first location to the second location.

* * * * *